US005619090A

United States Patent [19]

Vervecken

[11] Patent Number: 5,619,090

[45] Date of Patent: Apr. 8, 1997

[54] LOW-PRESSURE SODIUM DISCHARGE LAMP

[75] Inventor: Karel R. Vervecken, Turnhout, Belgium

[73] Assignee: U.S. Philips Corporation, New York, N.Y.

[21] Appl. No.: 491,752

[22] Filed: Jun. 19, 1995

[30] Foreign Application Priority Data

Jun. 22, 1994 [EP] European Pat. Off. ..... 94201783

[51] Int. Cl.[6] ..... H01J 61/74; H01J 61/34

[52] U.S. Cl. ..... 313/25; 313/43; 313/318.1; 313/318.09

[58] Field of Search ..... 313/318.01, 318.09, 313/318.1, 25, 43

[56] References Cited

U.S. PATENT DOCUMENTS 4,808,877 2/1989 Netten et al. ..... 313/25

FOREIGN PATENT DOCUMENTS 865928 9/1961 United Kingdom .

*Primary Examiner*—Nimeshkumar Patel

*Attorney, Agent, or Firm*—Walter M. Egbert, III

[57] ABSTRACT

The low pressure sodium discharge lamp has an outer envelope (1) in which a U-shaped discharge tube (10) is accommodated. A mica disk (20) having holes (21 ) through which pinches (11) of the discharge tube extend, keeps the discharge tube centered. The mica disk (20) has teeth (22) at its periphery, which are bent towards the lamp base (5) and clampingly engage the outer envelope. The disk allows for the outer envelope to be fused to a flared tube (3) in a drop-seal process and provides several additional features.

20 Claims, 2 Drawing Sheets

LOW-PRESSURE SODIUM DISCHARGE LAMP

BACKGROUND OF THE INVENTION

The invention relates to a low-pressure sodium discharge lamp provided with an evacuated, tubular glass outer bulb which is closed in a gastight manner with a first end portion where a glass stemtube enters the outer bulb, having a pinch seal inside the outer bulb, which end portion supports a lamp cap provided with contacts, and with a second end portion having a dome shape;

a glass discharge tube bent into a U-shape with end portions which are each closed in a gastight manner and each have a pinch through which a respective current conductor is passed to an electrode arranged in the end portion in question, which discharge tube is filled with sodium and rare gas;

electrical conductors which extend each from a respective contact of the lamp cap through the pinch seal so as to be connected to a respective current conductor;

a substantially plane mica plate with openings through each of which a respective pinch is passed, acting as a first centring member which keeps the discharge tube centred in the outer bulb, and a second centring member for the discharge tube in the second end portion of the outer bulb.

Such a low-pressure sodium discharge lamp is known from GB 865 928-B.

During manufacture of this lamp, the outer bulb must be held with its first end portion upwards while the outer bulb is being fused to the stemtube in order to prevent the discharge tube from dropping from the outer bulb. This is a disadvantage because a quicker and more reproducible fusion is obtained when an outer bulb has an excess longitudinal dimension and is fused to the stemtube while its second end portion is pointing upwards. When the outer bulb is heated locally, it constricts in this location and fuses with the stemtube. The excess length portion then drops off because it loses its connection to the outer bulb. This fusion method is called "drop seal" for that reason.

The known lamp could be manufactured by the drop seal method if the second centring member, a resilient bracket in the known lamp, had a strong clamping action both around the discharge tube and in the outer bulb, as a result of which the discharge tube would be suspended. Such a centring member, however, would lead to a considerable price increase.

Another possibility would be to use a metal clamp near the first centring member. Such a metal clamp, however, would have the disadvantage not only of increasing the cost price of the lamp, but also that it may cause damage to the outer bulb. An evaporated getter is often present for maintaining a vacuum in the outer bulb, for example a barium mirror on the outer bulb wall. This mirror is obtained in that barium is evaporated from a holder after the outer bulb has been sealed. The holder is heated inductively for this purpose. A metal body, for .example a blade spring, in contact with the outer bulb becomes red-hot then and strongly heats the outer bulb locally. This may cause stresses leading to fractures.

SUMMARY OF THE INVENTION

It is an object of the invention to provide a low-pressure sodium discharge lamp of the kind described in the opening paragraph which is of a simple construction which can be readily realised.

According to the invention, this object is achieved in that the mica plate has projecting teeth at its periphery which are bent towards the lamp cap and bear on the outer bulb with clamping action.

It was found to be possible with a material such as mica, with its characteristic layered structure, to combine the function of a centring member with the function of a fixation member. Owing to this latter function, the mica plate keeps the discharge tube in place in the outer bulb when the outer bulb is held with its dome upwards while the fusion seal with the stemtube is being made. This renders it possible to make a drop seal without additional components being used and without a metal component being used. Inductive heating for evaporating a getter is thus possible without the risk of damage to the outer bulb.

In a favourable embodiment, the mica plate has projecting teeth at its periphery in a first and in art opposed third sector of the plate, and has an unindented outer edge in a second and in an opposed fourth sector lying between the first and the third sectors. This embodiment has the advantage of a good fixation caused by the cooperating teeth of the first and third sectors, and a good centring caused by the circumferences of the unindented second and fourth sectors.

In an attractive embodiment, the electrical conductors project each through a respective opening in the mica plate and extend, bent around the outer edge, to a respective current conductor. This embodiment has the advantage that the stemtube, the discharge tube, and the mica plate may now be united into one assembly before they are introduced into the outer bulb. In a modification, the circumference has recesses each accommodating a respective electrical conductor. The electrical conductors thus have a well-defined, previously determined path in the lamp.

In a favourable embodiment, the pinch seal of the stemtube is in contact with the mica plate. This provides an additional locking of the discharge tube against longitudinal displacements in the outer bulb in the finished lamp. The embodiment described, in which the electrical conductors are passed through openings in the mica plate, renders possible a direct contact between the pinch seal and the mica plate, while preventing said conductors being sharply bent by the pinch and the plate.

An advantageous embodiment is one wherein the discharge tube has a tipped exhaust tube which is directed at the second end portion of the outer bulb, while the second centring member is a mica plate having an opening in which said tipped exhaust tube is accommodated, which mica plate rests against the outer bulb in longitudinal direction thereof. This embodiment has the advantage that two centring members are used which are substantially plane and thus have little volume as components, and which can be easily manufactured in a simple stamping operation from mica sheets.

The mica plates are highly suitable for fastening any additional lamp components thereto. The plates may have openings for this purpose in which such a component is clamped, or through which a wire-shaped component is passed in order to be subsequently fixed through bending. It is possible, for example, to fix a catalyst in a mica plate in this way, which decomposes hydrocarbons so that their decomposition products can be bound by a getter. Such a catalyst may be, for example, a porous $SiO_2$ and/or $Al_2O_3$ rod in which, for example, 0.5% Pt by weight is present.

The outer bulb may have a mirror of, for example, barium on its wall between the first centring member and the lamp cap, which barium originates from a holder positioned in this space and fixed, for example, to the mica plate or to a current conductor or electrical conductor. Gaseous impurities may then be removed by this getter mirror.

The mica plates may have blank openings which facilitate evacuation of the outer bulb.

BRIEF DESCRIPTION OF THE DRAWINGS

An embodiment of the low-pressure sodium discharge lamp according to the invention is shown in the drawing, in which.

DESCRIPTION OF THE PREFERRED EMBODIMENTS

Figure 1:
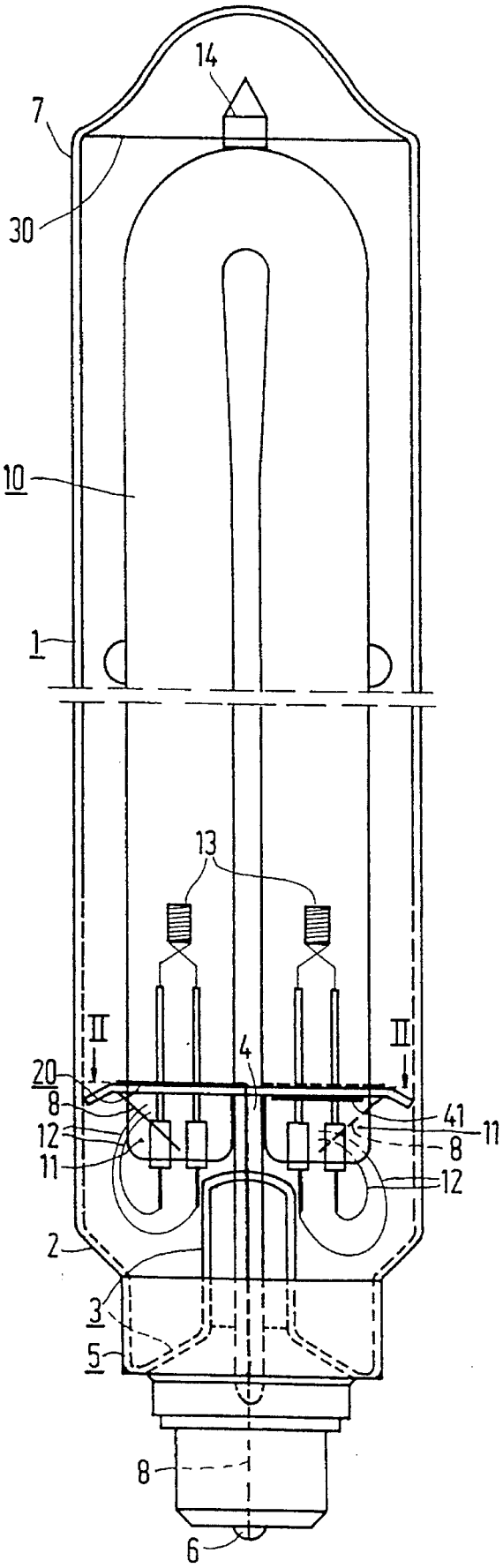
FIG. 1 shows a lamp in side elevation.

In FIG. 1, the low-pressure sodium discharge lamp has an evacuated, tubular glass outer bulb 1 which is closed in a gastight manner and which has a first end portion 2 where a glass stemtube 3 enters the outer bulb. The stemtube has a pinch seal 4 inside the outer bulb. The first end portion 2 supports a lamp cap 5 provided with contacts 6. The outer bulb has a second end portion 7 with a dome shape.

The lamp has a glass discharge tube 10 bent into a U-shape with end portions each closed in a gastight manner by means of a pinch 11. A current conductor 12 extends through each pinch to an electrode 13 arranged in the relevant end portion. The discharge tube is filled with sodium and rare gas.

Electrical conductors 8 extend each from a contact 6 of the lamp cap 5 through the pinch seal 4 so as to be connected to a respective current conductor 12.

A substantially plane mica plate 20 with openings 21, through which respective pinches 11 are passed, forms a first centring member and keeps the discharge tube 10 centred in the outer bulb 1. A second centring member 30 for the discharge tube is present in the second end portion 7 of the outer bulb.

The outer bulb has a heat-reflecting, light-transmitting coating at its inside, for example of tin-doped indium oxide.

Figure 2:
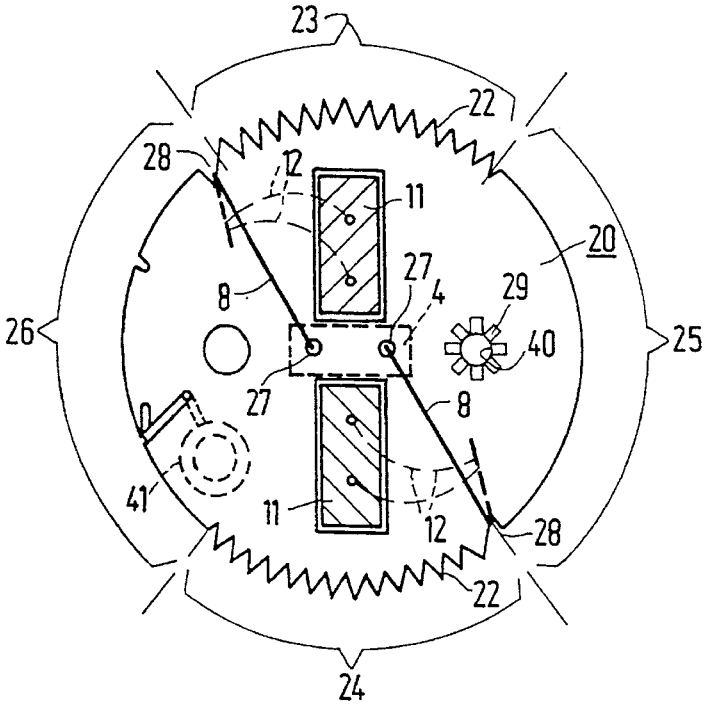
FIG. 2 is a view along II in FIG. 1 with the discharge tube in cross-section.

The mica plate 20 (see also FIG. 2) has projecting teeth 22 at its periphery, bent towards the lamp cap 5 and bearing on the outer bulb 1 with clamping action. A holder 41 is mounted in the lamp, from which holder a getter is to be evaporated which deposits on the wall of the outer bulb as a film and can bind gases such as water and hydrogen. To keep the drawing clear, the lamp is shown in its stage of manufacture in which the getter has not yet been evaporated, for example, through inductive heating.

The outer bulb is fused to the stemtube in a vertical position in which the second end portion points upwards. The discharge tube, the stemtube, the second centring member, and the mica plate are held in place in the outer bulb exclusively owing to the teeth of the mica plate during this.

Figure 3:
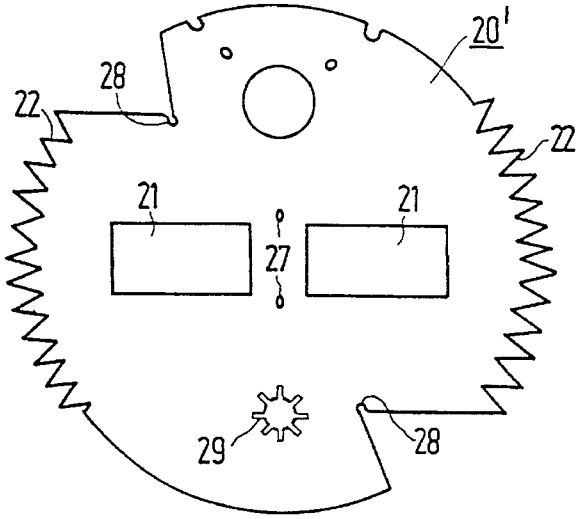
FIG. 3 shows an alternative embodiment of the mica plate of FIG. 1.

The mica plate 20 shown (see FIG. 2) has teeth 22, as does its modification 20' in FIG. 3, at its periphery in a first 23 and an opposed third sector 24 of the plate, and has an unindented periphery in a second 25 and an opposed fourth sector 26 which lie between the first and third sectors.

The electrical conductors 8 extend through respective openings 27 in the mica plate 20, are bent around the periphery, and extend to respective current conductors 12.

The plate 20 has recesses 28 in its outer edge in which respective electrical conductors 8 are accommodated.

The pinch seal 4 of the stemtube 3 is in contact with the mica plate 20.

Figure 4:
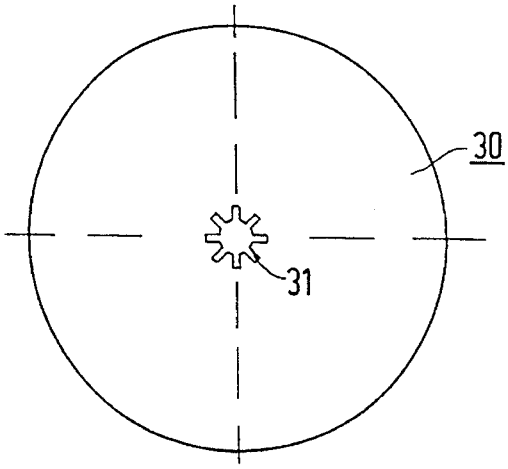
FIG. 4 shows an embodiment of the second centring member.

The discharge tube 10 has a tipped exhaust tube 14 which is directed at the second end portion 7 of the outer bulb 1, and the second centring member 30 is a mica plate (see FIG. 4) with an opening 31 in which said tipped exhaust tube 14 is accommodated. The second centring member 30 rests against the outer bulb 1 in the longitudinal direction thereof.

An additional component 40 of the lamp (see FIG. 2) is clamped in in an opening 29 in the first centring member. This is a porous ceramic rod in the Figure, impregnated with platinum for decomposing hydrocarbons such as methane.

I claim:

1. A low-pressure sodium discharge lamp provided with an evacuated, tubular glass outer bulb which is closed in a gastight manner with a first end potion where a glass stemtube enters the outer bulb, having a pinch seal inside the outer bulb, which end portion supports a lamp cap provided with contacts, and with a second end portion having a dome shape;

a glass discharge tube bent into a U-shape with end portions which are each closed in a gastight manner and each have a pinch through which a respective current conductor is passed to an electrode arranged in the end portion in question, which discharge tube is filled with sodium and rare gas;

electrical conductors which extend each from a respective contact of the lamp cap through the pinch seal so as to be connected to a respective current conductor;

a substantially plane mica plate with openings through each of which a respective pinch is passed, acting as a first centring member which keeps the discharge tube centred in the outer bulb, and a second centring member for the discharge tube in the second end portion of the outer bulb, characterized in that the mica plate has projecting teeth at its periphery which are bent towards the lamp cap and bear on the outer bulb with clamping action.

2. A low-pressure sodium discharge lamp as claimed in claim 1, characterized in that the mica plate has the projecting teeth at its periphery in a first and in an opposed third sector of the plate, and has an unindented outer edge in a second and in an opposed fourth sector lying between the first and the third sectors.

3. A low-pressure sodium discharge lamp as claimed in claim 2, characterized in that the electrical conductors project each through a respective opening in the mica plate and extend, bent around the outer edge of the mica plate, to a respective current conductor.

4. A low-pressure sodium discharge lamp as claimed in claim 3, characterized in that the plate has recesses at its circumference, each accommodating a respective electrical conductor.

5. A low-pressure sodium discharge lamp as claimed in claim 3, characterized in that the pinch seal of the stemtube is in contact with the mica plate.

6. A low-pressure sodium discharge lamp as claimed in claim 5, characterized in that the discharge tube has a tipped exhaust tube which is directed at the second end portion of the outer bulb, while the second centring member is a mica plate having an opening in which said tipped exhaust tube is accommodated, said second centring member resting against the outer bulb in longitudinal direction thereof.

7. A low-pressure sodium discharge lamp as claimed in claim 6, characterized in that an additional component of the lamp is fixed with clamping action in an opening in the first centring member.

8. A low-pressure sodium discharge lamp as claimed in claim 1, characterized in that the electrical conductors project each through a respective opening in the mica plate and extend, bent around the outer edge of the mica plate, to a respective current conductor.

9. A low-pressure sodium discharge lamp as claimed in claim 8, characterized in that the plate has recesses at its circumference, each accommodating a respective electrical conductor.

10. A low-pressure sodium discharge lamp as claimed in claim 8, characterized in that the pinch seal of the stemtube is in contact with the mica plate.

11. A low-pressure sodium discharge lamp as claimed in claim 8, characterized in that the discharge tube has a tipped exhaust tube which is directed at the second end portion of the outer bulb, while the second centering member is a mica plate having an opening in which said tipped exhaust tube is accommodated, said second centering member resting against the outer bulb in longitudinal direction thereof.

12. A low-pressure sodium discharge lamp as claimed in claim 11, characterized in that an additional component of the lamp is fixed with clamping action in an opening in the first centering member.

13. A low-pressure sodium discharge lamp as claimed in claim 2, characterized in that the pinch seal of the stemtube is in contact with the mica plate.

14. A low-pressure sodium discharge lamp as claimed in claim 13, characterized in that the discharge tube has a tipped exhaust tube which is directed at the second end portion of the outer bulb, while the second centering member is a mica plate having an opening in which said tipped exhaust tube is accommodated, said second centering member resting against the outer bulb in longitudinal direction thereof.

15. A low-pressure sodium discharge lamp as claimed in claim 14, characterized in that an additional component of the lamp is fixed with clamping action in an opening in the first centering member.

16. A low-pressure sodium discharge lamp as claimed in claim 1, characterized in that the pinch seal of the stemtube is in contact with the mica plate.

17. A low-pressure sodium discharge lamp as claimed in claim 16, characterized in that the discharge tube has a tipped exhaust tube which is directed at the second end portion of the outer bulb, while the second centering member is a mica plate having an opening in which said tipped exhaust tube is accommodated, said second centering member resting against the outer bulb in longitudinal direction thereof.

18. A low-pressure sodium discharge lamp as claimed in claim 3, characterized in that the discharge tube has a tipped exhaust tube which is directed at the second end portion of the outer bulb, while the second centering member is a mica plate having an opening in which said tipped exhaust tube is accommodated, said second centering member resting against the outer bulb in longitudinal direction thereof.

19. A low-pressure sodium discharge lamp as claimed in claim 2, characterized in that the discharge tube has a tipped exhaust tube which is directed at the second end portion of the outer bulb, while the second centering member is a mica plate having an opening in which said tipped exhaust tube is accommodated, said second centering member resting against the outer bulb in longitudinal direction thereof.

20. A low-pressure sodium discharge lamp as claimed in claim 1, characterized in that the discharge tube has a tipped exhaust tube which is directed at the second end portion of the outer bulb, while the second centering member is a mica plate having an opening in which said tipped exhaust tube is accommodated, said second centering member resting against the outer bulb in longitudinal direction thereof.

* * * * *